US007178365B2

(12) United States Patent
Pitaniello

(10) Patent No.: US 7,178,365 B2
(45) Date of Patent: Feb. 20, 2007

(54) MULTI-PIECE JEWELRY ASSEMBLY

(76) Inventor: Kristina Pitaniello, 551 Tremont St. #316, Boston, MA (US) 02116

( * ) Notice: Subject to any disclaimer, the term of this patent is extended or adjusted under 35 U.S.C. 154(b) by 0 days.

(21) Appl. No.: 11/081,318

(22) Filed: Mar. 16, 2005

(65) Prior Publication Data

US 2006/0207287 A1 Sep. 21, 2006

(51) Int. Cl.
*A44C 9/00* (2006.01)

(52) U.S. Cl. ..... 63/15

(58) Field of Classification Search ..... 63/15, 63/15.1–15.4, 15.7, 15.9, 3, 3.1, 11, 12, 13; D11/26–34
See application file for complete search history.

(56) References Cited

U.S. PATENT DOCUMENTS 3,668,890 A * 6/1972 Broido ..... 63/3
2006/0053835 A1* 3/2006 Roberts Shea ..... 63/15

* cited by examiner

*Primary Examiner*—Jack W. Lavinder
(74) *Attorney, Agent, or Firm*—Fish & Richardson P.C.

(57) ABSTRACT

A jewelry assembly includes a first piece with two apertures and a first flexibility characteristic. The assembly also includes a second piece that with a second flexibility characteristic less than the first flexibility characteristic. The second piece also has two flanges. Each flange is configured to be received by a corresponding one of the apertures of the first piece in a first orientation. Each flange is also configured to be secured within the associated aperture in a second orientation. The first and second pieces, in aggregate, substantially conform to a contour of a wearer.

17 Claims, 6 Drawing Sheets

MULTI-PIECE JEWELRY ASSEMBLY

TECHNICAL FIELD

This invention relates to accessories, and more particularly to a multi-piece jewelry assembly that is adaptable to rings, necklaces and bracelets.

BACKGROUND

Jewelry such as rings, necklaces and bracelets come in a wide variety of designs. A single, continuous piece typically forms rings and bracelets. A single piece with ends joined by a clasp may form bracelets and necklaces in other configurations.

SUMMARY

In one aspect, the invention relates to a jewelry assembly including a first piece with two apertures and a first flexibility characteristic and a second piece with a second flexibility characteristic less than the first flexibility characteristic. The second piece has two flanges, each configured to be received by a corresponding one of the apertures of the first piece in a first orientation. The flanges are also configured to be secured within the associated aperture in a second orientation. The first and second pieces, in aggregate, substantially conform to a contour of a wearer.

One aspect of the invention may have one or more of the following features. The first piece may include a first and second edge. A first aperture of the two apertures may be proximate to the first edge; and a second aperture of the two apertures may be proximate to the second edge. The apertures may include two portions. The first portion is approximately circular in shape; the second portion is a slit connecting to the first portion and extending away from its associated edge. The second piece may have first and second ends. Each end may include a rib, and the flange may include button, which may be spherical or non-spherical. A distance between the rib and the button may be approximately equal to a width of the first piece. The first piece may be secured between the ridge and the button when the pieces are assembled. The first and second ends of the second piece form a connecting span between each end. In one aspect of the invention one end of the second piece may be permanently fixed to one end of the first piece, while the second end remains removable. The connecting span of the second piece may be sized to fit the contour of the wearer. The jewelry assembly forms a ring, a bracelet, a necklace, or a belt. Each flange may be a knob. The first piece may include leather and a decorative outer surface. Alternatively, the first piece may be formed of acrylic, resin, cloth, or rubber. The second piece may include metal, In another aspect of the invention, a jewelry assembly may include a flexible piece with both a first and second aperture proximate their respective edges. Each aperture includes a first and second portion. The first portion may be approximately circular in shape, and the second portion may be a slit connecting to the first portion and extending approximately perpendicularly to the edges. The assembly also includes a rigid, non-linear piece that has a first and second end. Each end includes a rib and a non-spherical button projection. The projection may have other shapes as well including spherical, conical, oblong and rectangular. A distance between the rib and the spherical button projection is approximately equal to the width of the flexible piece. The first and second ends form a connecting span between each end. Each spherical button projection is aligned with a corresponding one of the non-symmetrical apertures. Each spherical button projection forms a continuous loop after being inserted through the corresponding one of the asymmetrical apertures. When the non-linear piece is rotated, it misaligns the asymmetrical apertures and non-spherical button projections. The flexible piece is secured between the ridge and the non-spherical button. The assembled pieces substantially conform to the wearer's contour. Contact with the wearer keeps the pieces assembled.

The first piece can be further decorated by attaching (e.g., with rivets) a piece of metal to it or by sliding other decorative items (e.g., a metal box).

Each aspect may have one or more of the following advantages. The multi-piece assembly allows a wearer to mix and match various decorative first pieces while using the same second piece. Depending on his interest in appearance, comfort or durability, the wearer may also mix and match various materials such as leather, wood, metals, ceramics, gems, minerals, and rubber for each of the pieces.

DESCRIPTION OF DRAWINGS

Like reference symbols in the various drawings indicate like elements.

DETAILED DESCRIPTION

Figure 1:
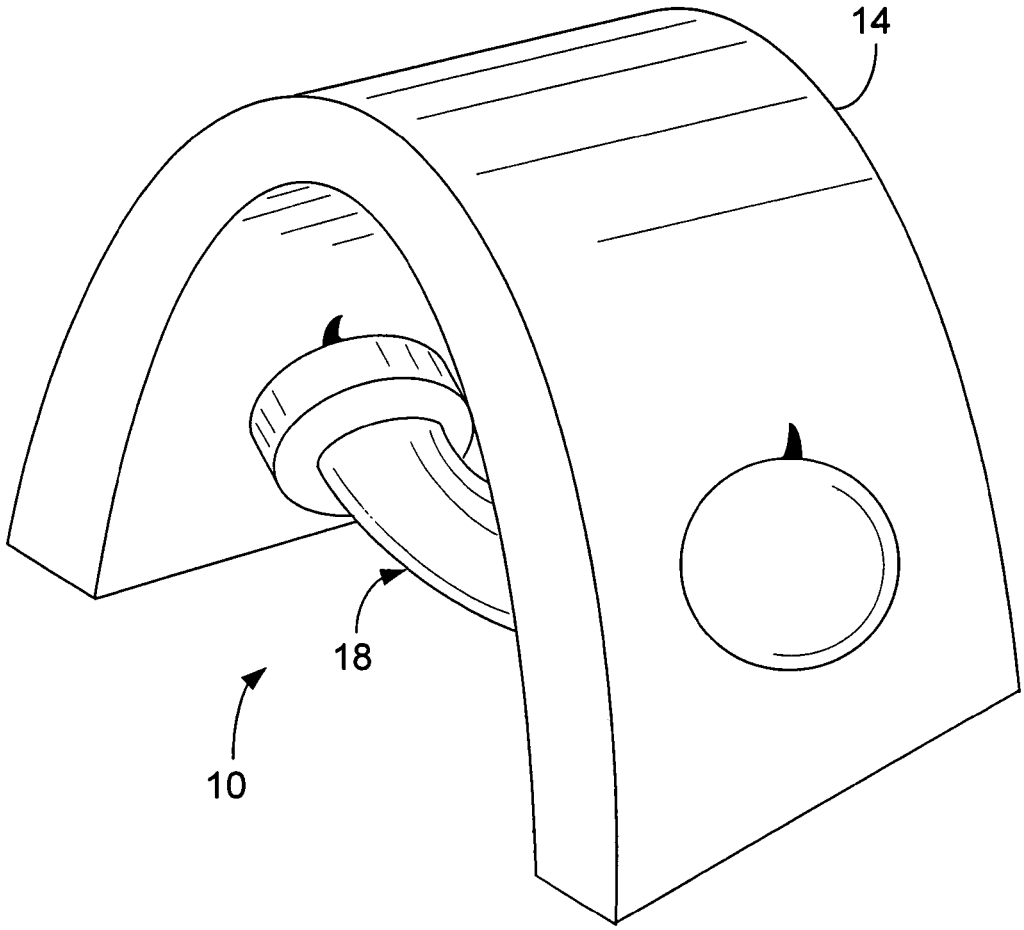
FIG. 1 is a perspective view of a jewelry assembly.

Referring to FIG. 1, jewelry designers constantly attempt to conceive new, functional designs that offer alternative aesthetics. To meet this need, a ring 10, which includes a first 14 and second piece 18, can be assembled and disassembled using different first and second pieces to form various ring configurations.

Figure 2:
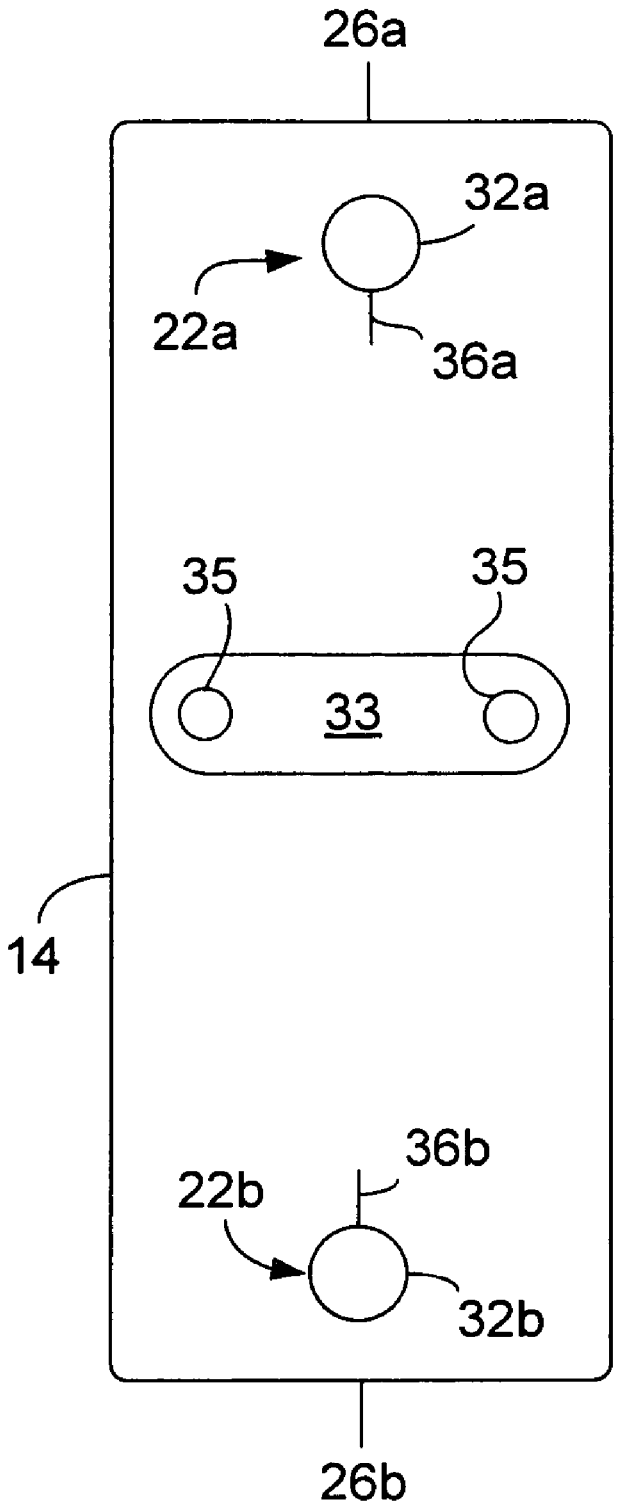
FIG. 2 is a top view of a first piece of the jewelry assembly.

Referring to FIG. 2, first piece 14 is a flexible, leather band that covers a top portion of a wearer's finger. First piece 14 is shown here to be generally rectangular. However, other designs may be shaped differently (e.g., oval). First piece 14 includes a first aperture 22*a* proximate to a first edge 26*a* and a second aperture 22*b* proximate to a second edge 26*b*. Each aperture 26*a* and 26*b* includes a circular opening (e.g., circular opening 32*a* and circular opening 32*b*) and a slit (e.g., slit 36*a* and slit 36*b*). Each slit 36*a* and 36*b* extends away from its associated circular opening 32*a* and 32*b*, opposite its associate edge 26*a* and 26*b*. For example, slit 36*a* extends away from circular opening 32*a*, opposite associated edge 26*a*.

Figure 3A:
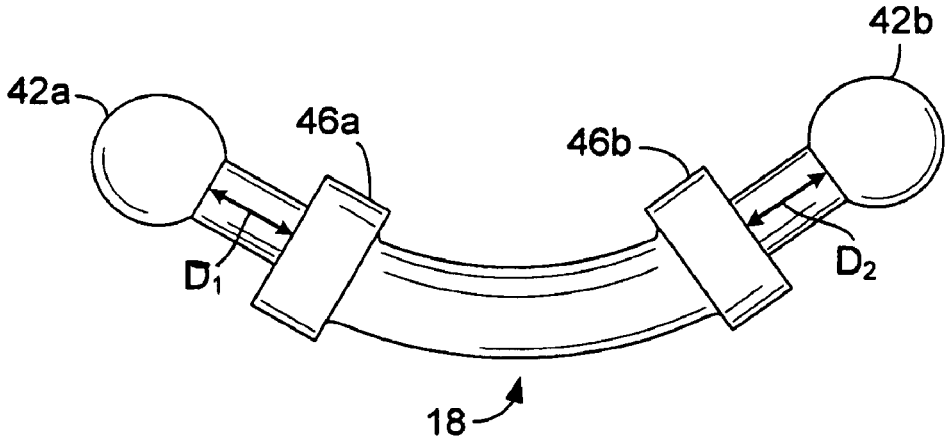
FIG. 3A is a top view of a second piece of the jewelry assembly.
Figure 3B:
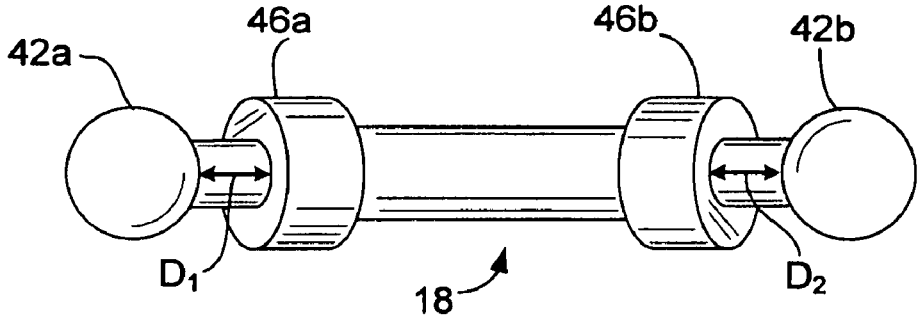
FIG. 3B is a side view of a second piece of the jewelry assembly.

Referring to FIG. 3A and 3B, second piece 18 is a rigid, non-linear metal piece (e.g., formed of aluminum) that fits the contour of a bottom portion of the wearer's finger and can be sized to fit the contour of the wearer's finger. Second piece 18 has a first 42*a* and second flange 42*b*. Second piece 18 also has a first 46*a* and second rib 46*b*. Distance D1, between first flange 42*a* and first rib 46*a*, and distance D2, between second flange 42*b* and second rib 46*b* are approximately equal to width W of first piece 14 shown in FIG. 4.

Figure 4:
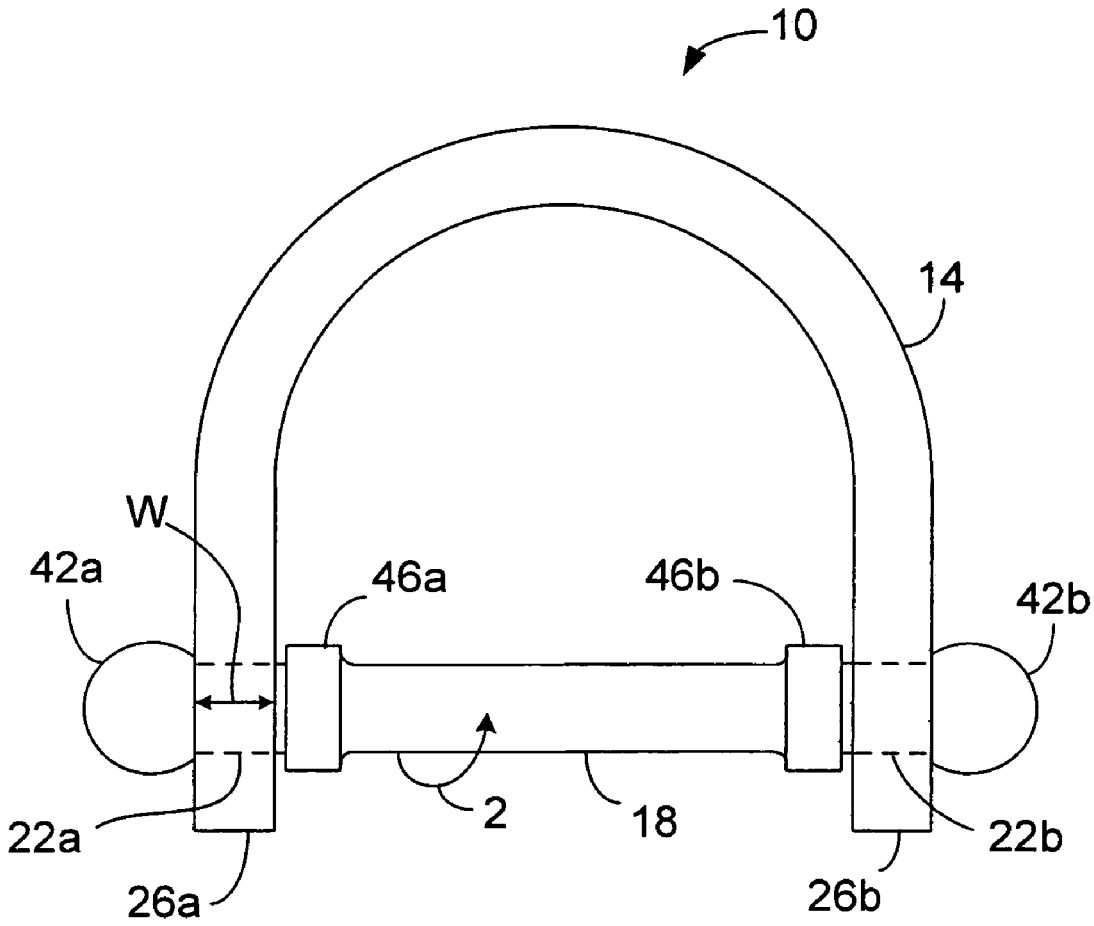
FIG. 4 is a side view of the jewelry assembly where the flanges are aligned with the apertures.

Referring to FIG. 4, the first piece 14 and the second piece 18 are assembled into ring 10 in a two-step process. First 42*a* and second flange 42*b* are each aligned and inserted through corresponding apertures 22*a* and 22*b*. For example, first flange 42*a* is inserted through aperture 22*a*, while second flange 42*b* is inserted through aperture 22*b*. In this configuration, ring 10 can be easily dissembled, but to secure the assembly, second piece 18 is rotated 90 degrees in rotation Z.

Figure 5:
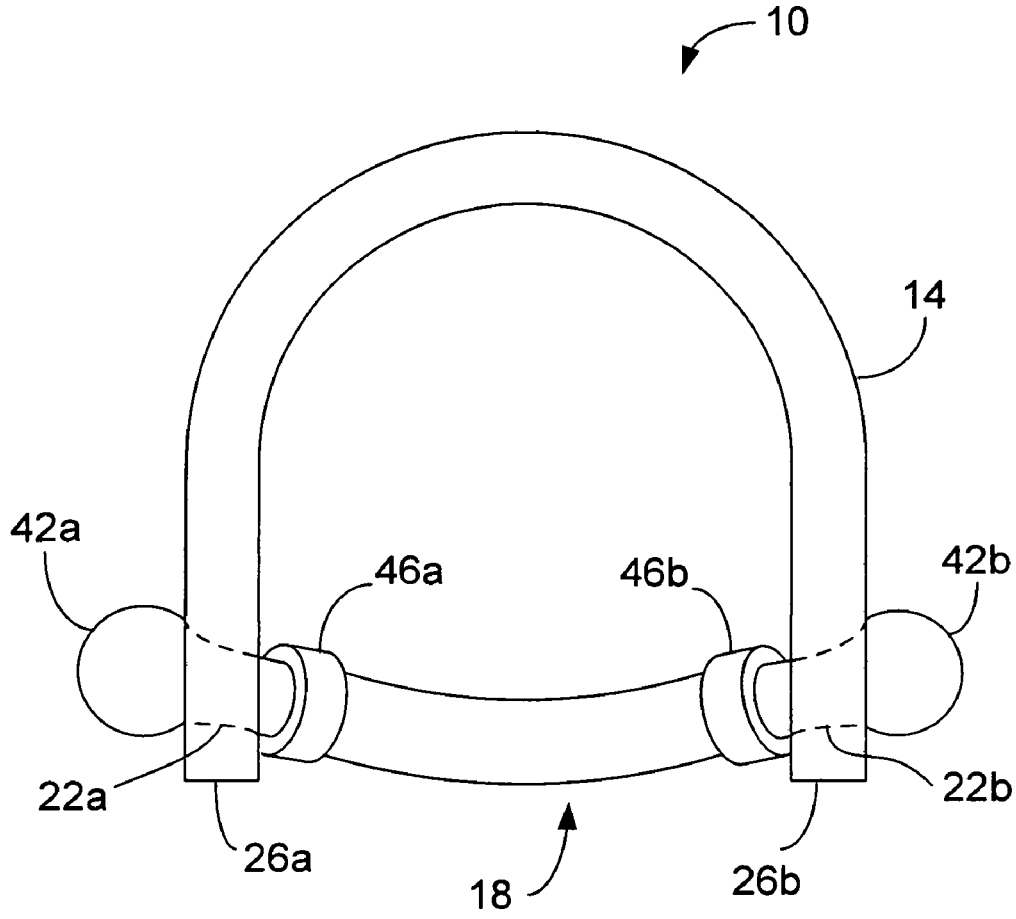
FIG. 5 is a side view of the jewelry assembly where the flanges are not aligned with the apertures.

Referring to FIG. 5, after the rotation, first 42*a* and second flange 42*b* are no longer aligned with first 22*a* and second aperture 22*b*, and first 14 and second piece 18 are secured together. In particular, first piece 14 is secured between first rib 46*a* and first flange 42*a* and also between rib 46*b* and flange 42*b*. This configuration maintains the size of the ring assembly. Additionally, the curvature of first piece 14 conforms to the contour of the wearer's finger in this configuration. Contact with the wearer's finger also keeps ring assembly 10 in the position illustrated in FIG. 5.

Figure 6:
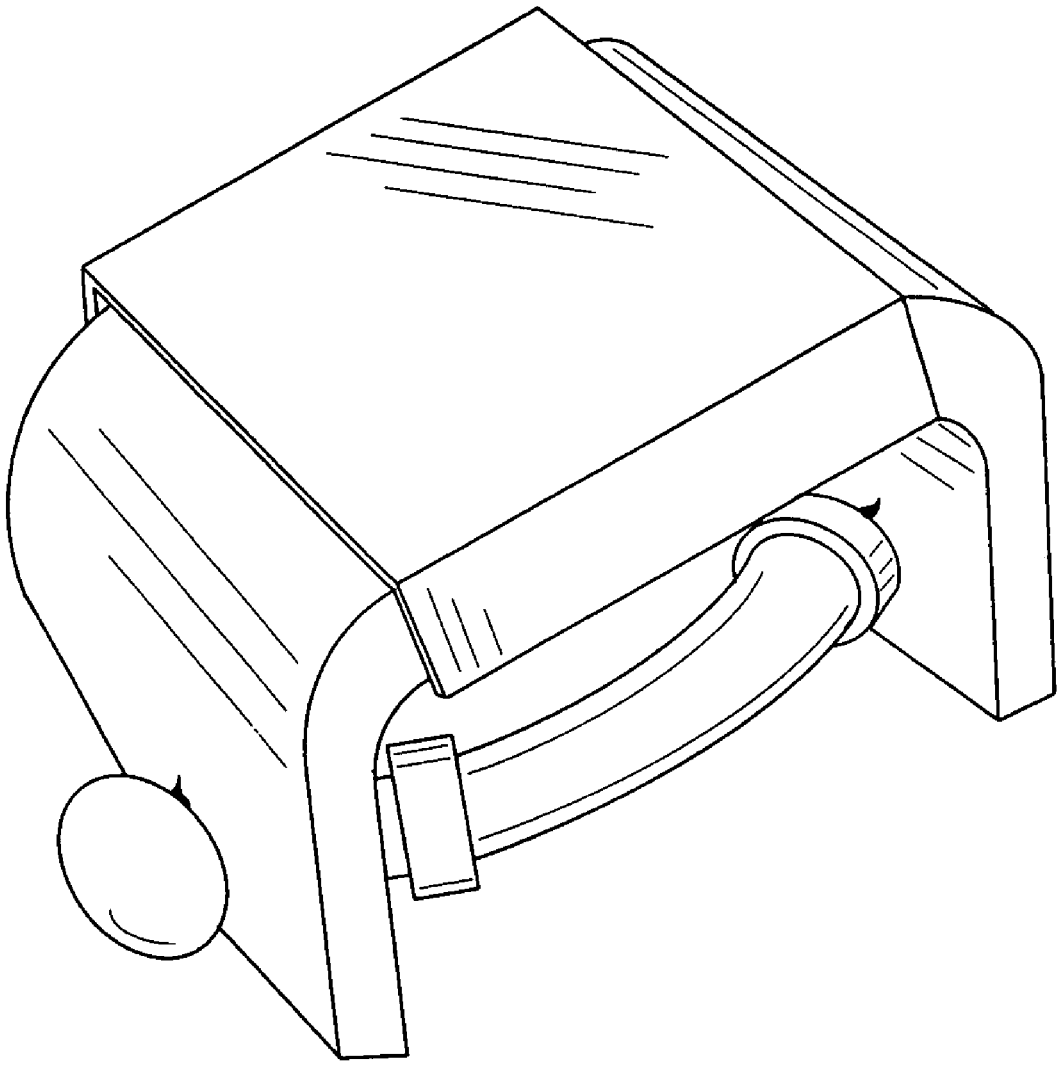
FIG. 6 is a perspective view of an alternative embodiment of a jewelry assembly.

In other embodiments, the appearance of the ring can be embellished by adding other decorative items. For example, referring to FIG. 6, a box 50, here made of metal, is mounted to first piece 14. In this embodiment, box 50 is slid over first piece prior to attachment to second piece 18. In other embodiments, box 50 may be permanently attached to first piece 14, for example using rivets (not shown). In this embodiment, box 50 is formed of a shiny and lustrous metal. In other embodiments, box 50 may be made of other materials and may include images placed upon or otherwise attached to the box.

An embodiment of the invention as a two or three-piece ring assembly has been described. Nevertheless, it will be understood that various modifications may be made without departing from the spirit and scope of the invention. For example, while the foregoing description describes a ring construction, the form of jewelry may also be applied to the construction of bracelets and necklaces. In other examples, additional pieces may be used: two second pieces attached to a first piece, for instance. In further examples, the first piece is visible on the top of the finger when the wearer bears the ring assembly; the first piece may have various shapes that alter decoration; or ornamentation may be added to the surface. Various flexible materials, such as rubber or plastics, may form the first piece. Similarly, other materials, such as wood, gems or minerals, may comprise the second piece.

In some examples, the flanges are knobs, while in others, the flanges are non-spherical buttons. In some examples, multiple materials may fabricate the ribs, flanges and other portions of the second. In other examples, each slit of the first piece extends perpendicularly to the piece's edges.

Accordingly, other embodiments are within the scope of the following claims.

What is claimed is:

1. A jewelry assembly comprising:

a first piece having two apertures and a first flexibility characteristic, wherein the first piece includes a first and a second edge, and a first aperture is proximate to the first edge and a second aperture is proximate to the second edge;

a second piece having a second flexibility characteristic that is less than the first flexibility characteristic and having two flanges, each flange being configured to be received by a corresponding one of the apertures of the first piece in a first orientation and each flange being configured to be secured within the associated aperture in a second orientation, wherein the second piece has a first and a second end, each end including a rib and the flange including a non-spherical button, where a distance between the rib and the non-spherical button is approximately equal to the width of the first piece;

wherein the first piece is secured between the ridge and non-spherical button when the pieces are assembled; and wherein the first and second pieces, in aggregate, substantially conform to a contour of a wearer.

2. The jewelry assembly of claim 1, wherein each aperture includes a first and a second portion, whereby the first portion is approximately circular in shape, and the second portion includes a slit connecting to the first portion and extending away from its associated edge.

3. The jewelry assembly of claim 1, wherein the first and second ends of the second piece form a connecting span between each end and the connecting span of the second piece is sized to fit the contour of the wearer.

4. The jewelry assembly of claim 1, wherein the jewelry assembly forms jewelry selected from the group consisting of a ring, a bracelet, and a necklace.

5. The jewelry assembly of claim 1, wherein each flange comprises a knob.

6. The jewelry assembly of claim 1, wherein the first piece comprises leather.

7. The jewelry assembly of claim 1, wherein the first piece comprises a decorative outer surface.

8. The jewelry assembly of claim 1, wherein the second piece comprises metal.

9. The jewelry assembly of claim 1 further comprising a metal piece mounted to the first piece.

10. A jewelry assembly comprising:

a flexible piece having a first aperture proximate a first edge and a second aperture proximate a second edge, each aperture including two portions, the first portion approximately circular in shape, the second portion including a slit connecting to the first portion and extending approximately perpendicularly to the edges;

a rigid, non-linear piece having a first and a second end, each end including a rib and a non-spherical button projection, a distance between the rib and the non-spherical button projection being approximately equal to the width of the flexible piece, the first and second ends forming a connecting span between each end;

wherein each non-spherical button projection is aligned with a corresponding one of the asymmetrical apertures, each non-spherical button projections is inserted through the corresponding one of the asymmetrical apertures forming a continuous loop, the non-linear piece is rotated resulting in a misalignment of the asymmetrical apertures and non-spherical button projections, wherein the flexible piece is secured between the ridge and the non-spherical button; and wherein the assembled pieces substantially conform to the contour of the wearer and contact with the wearer keeps the pieces assembled.

11. The jewelry assembly of claim 10, wherein the connecting span of the non-linear piece is sized to fit the contour of the wearer.

12. The jewelry assembly of claim 10, wherein the jewelry assembly forms jewelry selected from the group consisting of a ring, a bracelet and a necklace.

13. The jewelry assembly of claim 10, wherein the flexible piece comprises leather.

14. The jewelry assembly of claim 10, wherein the flexible piece comprises a decorative outer surface.

15. The jewelry assembly of claim 10, wherein the non-linear piece comprises metal.

16. The jewelry assembly of claim 10, wherein the non-linear piece comprises metal.

17. The jewelry assembly of claim 10 further comprising a metal piece mounted to the flexible piece.

* * * * *